US006095054A

United States Patent [19]

Kawano et al.

[11] Patent Number: 6,095,054

[45] Date of Patent: Aug. 1, 2000

[54] TRANSPORT SYSTEM

[75] Inventors: Hitoshi Kawano; Masanao Murata; Tanaka Tsuyoshi; Atsushi Okuno, all of Ise, Japan

[73] Assignee: Shinko Electric Co., Ltd., Tokyo, Japan

[21] Appl. No.: 09/052,625

[22] Filed: Mar. 31, 1998

[30] Foreign Application Priority Data

Feb. 3, 1998 [JP] Japan ..... 10-022372

[51] Int. Cl.[7] ..... B61F 13/00; E01B 25/00

[52] U.S. Cl. ..... 104/139; 104/130.07; 104/140; 104/290; 191/10

[58] Field of Search ..... 104/88.01, 88.02, 104/88.03, 88.04, 118, 111, 126, 130.07, 138.1, 139, 140, 292, 279, 280, 290; 198/860.1; 414/222; 191/10

[56] References Cited

U.S. PATENT DOCUMENTS

| | | | |
|---|---|---|---|
| 3,593,668 | 7/1971 | Adams | 104/130.07 |
| 3,830,163 | 8/1974 | Wright et al. | 104/130.07 |
| 3,913,491 | 10/1975 | Auer et al. | 104/130.07 |
| 4,132,175 | 1/1979 | Miller et al. | 104/130.07 |
| 4,620,486 | 11/1986 | Gronau et al. | 104/130.07 |
| 4,671,185 | 6/1987 | Anderson et al. | 104/130.07 |
| 4,841,869 | 6/1989 | Takeuchi et al. | 104/292 |
| 4,903,610 | 2/1990 | Matsumoto et al. | 104/118 |
| 5,029,697 | 7/1991 | McMillian et al. | 198/860.01 |
| 5,443,346 | 8/1995 | Murata et al. | 414/222 |
| 5,467,718 | 11/1995 | Shibata et al. | 104/284 |
| 5,838,079 | 11/1998 | Morohashi et al. | 310/12 |

FOREIGN PATENT DOCUMENTS

| | | |
|---|---|---|
| 0 132 934 | 2/1985 | European Pat. Off. . |
| 6-171708 | 6/1994 | Japan . |
| 2 110 448 | 6/1983 | United Kingdom . |
| 2 113 633 | 8/1983 | United Kingdom . |
| 2 145 046 | 3/1985 | United Kingdom . |
| WO 87/04676 | 8/1987 | WIPO . |

*Primary Examiner*—Mark T. Le
*Attorney, Agent, or Firm*—Darby & Darby

[57] ABSTRACT

A transport system has a track provided along a transport route forming a main route and at least one branch route connected to the main route at a branch point. A first power supply line is provided along the main route; a second power supply line is provided along the branch route and a transport vehicle moves along the track. There is a drive unit for driving the transport vehicle along the track with the drive unit being attached to the transport vehicle, a route selector for selecting a branch route at the branch point and a power receiver for receiving electric power from the first and second power supply lines to supply electric power to the drive unit.

8 Claims, 12 Drawing Sheets

TRANSPORT SYSTEM

FIELD OF THE INVENTION

The present invention relates in general to a transport system with a branch route which can be applied to, for example, facilities for manufacturing semiconductor devices or to hospitals.

This application is based on Japanese Patent Applications Nos. Hei 8-264882 and Hei 10-22372, the contents of which are incorporated herein by reference.

BACKGROUND ART

As demand for electrical devices are recently increased, manufacturing of semiconductor devices and wafers has increased. In general, manufacturing processes of semiconductor devices and wafers is carried out in a clean room in which a rail transport system has been used for a number of years in order to transfer objects to a target station. It has become increasingly desirable to increase transport capacity in order to raise productivity and to reduce manufacturing costs.

The conventional transport system employs a looped track and several transport vehicles traveling on the track. Since increase of transport capacity cannot be achieved using the looped track system, several branch tracks are connected to a main track to allow passing of the transport vehicles. A sliding table or a turntable for switching the main track or the branch track is provided at the branch point.

As shown in FIG. 10, a sliding-type track change mechanism 91 for a linear transport system has a sliding table 94 which is slidable between the main route 92 and the branch route 93. The sliding table 94 travels and returns on a linear guide 95 making a right angle with the main route 92 and the branch route 93. A drive screw 96 connected to a driving unit 97 is provided, and these are supported by a frame 98. The sliding table 94 is moved by the rotation of the drive screw 96.

With such a construction, the sliding table 94 is first positioned to allow the transport vehicle 99 in the main route 92 to come therein. The transport vehicle 99 passes a point A in front of the sliding table 94, travels into the sliding table 94, and stops at a point B. The sliding table 94 slides in a direction C to the branch route 93. The transport vehicle 99 comes into the branch route 93, at which point the change of route is completed.

As shown in FIG. 11, a turntable-type track change mechanism 101 for a linear transport system has a turntable 104 which pivots on a point between the main route 102 and branch route 103, and a frame 106 for supporting the turntable 104 and other parts. The turntable 104 is rotated by a drive unit 105.

With the turntable-type track change mechanism 101, a transport vehicle 107 passes a point A in front of the turntable 104, goes into the turntable 104, and stops at a point B on the turntable 104. The turntable 104 is rotated through 180 degrees to allow the transport vehicle to go to a point C. The transport vehicle 107 starts traveling on the branch route 103, at which point the change of route is completed.

As shown in FIG. 12A, the transport vehicles 99 and 107 used in the above-described mechanisms 91 and 101 have side guide rollers 111 which contact an inside wall of the track and four support wheels attached at corners of their bodies. As shown in FIG. 12B, a primary unit (stationary part) 113 of a linear motor is provided on the track, and a secondary conductor (movable part) 114 of the linear motor is provided under the bodies of the transport vehicles 99 and 107, in order to generate the motive power by magnetic induction. The transport vehicles 99 and 107 are supported in the track and move along the track.

In the conventional transport system using the above switching route mechanism, the following problems occur.

(1) Since the track change operation takes time and restricts the travel of the following transport vehicle, the time required for transportation is relatively long and the transportation capacity is decreased.

(2) When the transport vehicle accidentally goes into the sliding table or the turntable before the completion of the route change operation, the transport vehicle may be derailed.

(3) The mechanism with the movable table requires the complicated structure of the track, and the branch point becomes larger in weight and size. The sliding-type track change mechanism 91 and the turntable-type track change mechanism 101 are provided since the transport vehicles 99 and 107 travel into the branch routes 93 and 103 by means of the sliding table 94 and the turntable 104. The mechanisms are comparatively heavy and the strength of the frames 98 and 106 and the drive screw 96 must be increased. When several branch mechanisms are provided, the manufacturing cost of the transport system is increased. The driving cost of the transport system is also high because the operation of the sliding table 94 and the turntable 104 requires large amounts of power. When the track rail is attached to a ceiling, troublesome construction is needed because of load durability.

(4) Because dust may be produced in the route change operation, a suction device is additionally needed. When the transport system is provided in a clean room of a facility for manufacturing a semiconductor device, influences on the semiconductor wafers due to the dust must be avoided and movable portions should not be exposed.

SUMMARY OF THE INVENTION

It is therefore an object of the present invention to provide a transport system which allows a transport vehicle to travel to a branch route, eliminating the mechanical track sliding or rotation, lowering manufacturing and running costs, and preventing dust from being spread.

In order to accomplish the above object, a transport system according the present invention comprises: a track provided along a transport route comprising a main route and at least one branch route connected to the main route at a branch point; a first power supply line provided along the main route; a second power supply line provided along the branch route; a transport vehicle for moving along the track; a drive unit for driving the transport vehicle along the track, the drive unit being attached to the transport vehicle; a route selector for selecting a branch route at the branch point; and a power receiver for receiving electric power from the first and second power supply lines so as to supply electric power to the drive unit.

According to the transport system of the present invention, sliding or rotating of a track is eliminated because the transport vehicle has the route selector. Accordingly, the transport capacity is increased because there is no time for sliding or rotating the track. The derailing of the transport vehicle can be prevented because the track is continuously formed, eliminating a sliding- or turntable-type track change mechanism. The transport system has no track change mechanism, thereby making the structure of the track simpler and lowering the cost. The construction to attach the track to the ceiling is facilitated and the load durability can be enhanced, because the weight of the track is reduced. The spreading of dust can be prevented because the track does not include a movable portion.

In another aspect of the present invention, a transport system further comprises a third power supply line for mediating between the first and second power supply lines, the third power supply line being provided at the branch point, the power receiver receiving electric power from the third power supply line when the transport vehicle is located at the branch point. The power receiver may be a pickup coil for receiving electric power in a non-contact manner from the first and second power supply lines. According to the transport system, the reliability of the supply of the electric power can be improved.

In another aspect of the present invention, the transport vehicle has wheels, and the route selector is a steering mechanism for turning the wheels. This invention makes the construction simpler and the operation easier.

In another aspect of the present invention, a transport system comprises: a main guide rail for supporting and guiding the transport vehicle, the main guide rail extending along the main route; and a branch guide rail for supporting and guiding the transport vehicle, the branch guide rail extending along the branch route. This invention makes the construction simpler and the operation easier.

In another aspect of the present invention, the transport vehicle has a movable contact portion, and a guide selector for selectively contacting the contact portion to one of the main guide rail and the branch guide rail. The main guide rail and the branch guide rail may be magnetic, and the contact portion may be a magnet roller.

In another aspect of the present invention, a transport system according to the present invention comprises: a track provided along a transport route comprising a main route and at least one branch route connected to the main route at a branch point; a main guide rail for supporting and guiding the transport vehicle, the main guide rail extending along the main route; a branch guide rail for supporting and guiding the transport vehicle, the branch guide rail extending along the branch route; a transport vehicle for moving along the track; a first roller attached to the transport vehicle, the first roller being movable to contact the main guide rail to guide the transport vehicle to the main route; a second roller attached to the transport vehicle, the second roller being movable to contact the branch guide rail to guide the transport vehicle to the branch route; and a guide selector for selectively contacting one of the first roller and the second roller selectively to one of the main guide rail and the branch guide rail.

According to the transport system of the present invention, sliding or rotating of a track is eliminated because the transport vehicle has the first and second rollers and the guide selector. Accordingly, the transport capacity is increased because there is no time for sliding or rotating the track. The derailing of the transport vehicle can be prevented because the track is continuously formed, eliminating a sliding- or turntable-type track change mechanism. The transport system has no track change mechanism, thereby making the structure of the track simpler and lowering the cost.

In another aspect of the present invention, the guide selector may move the first roller and the second roller vertically. Each of the main and branch guide rails may comprise a vertical wall for supporting the rollers, and a horizontal support for supporting the walls.

In another aspect of the present invention, a transport system comprises a cover for covering the transport route and the transport vehicle. The transport system may further comprise an air cleaner for collecting dust from the transport route. The transport system may further comprise an air supply means to supply clean air into the cover, and the air cleaner collects the dust to exhaust clean air out of the cover. According to the present invention, the spreading of dust can be prevented because the track and the transport vehicle are not exposed.

DETAILED DESCRIPTION OF THE PREFERRED EMBODIMENTS

First Embodiment

Referring to FIGS. 1 to 4, the best mode of the transport system, according to a first embodiment of the present invention, will be explained.

Figure 1:
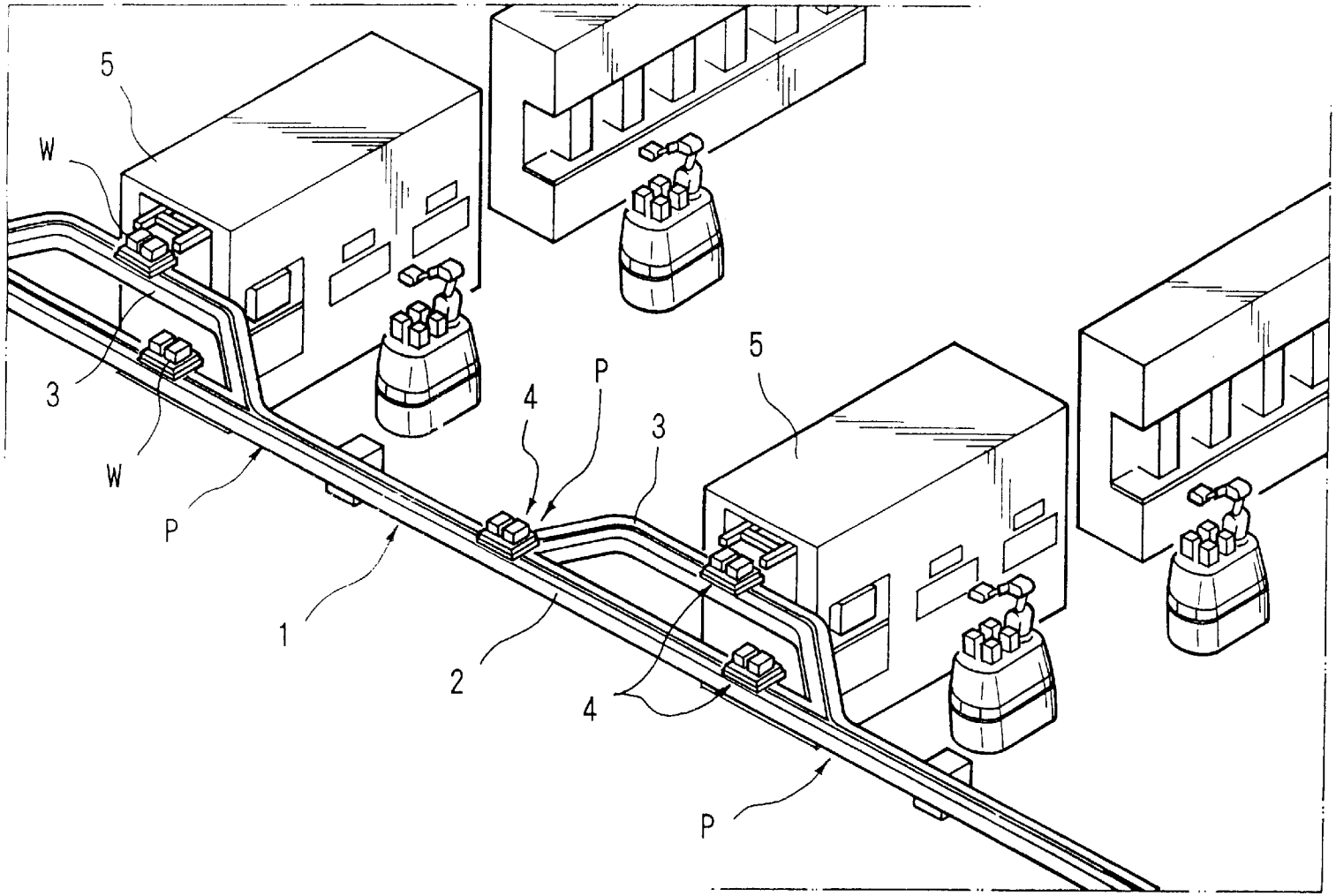
FIG. 1 is a schematic illustration of a transport system of a first embodiment of the present invention.

FIG. 1 outlines a first embodiment of a transport system 1, which is installed in a clean room and which transports cassettes W storing semiconductor wafers between cassette stockers (stations) 5. The transport system 1 has a looped main track 2 and branch tracks 3 connecting each one of the cassette stockers 5. The branch tracks 3 branch from and join to the main track 3. The tracks 2 and 3 guide a transport vehicle 4 loading the cassette W, and are fixed to, for example, a ceiling.

Figure 2:
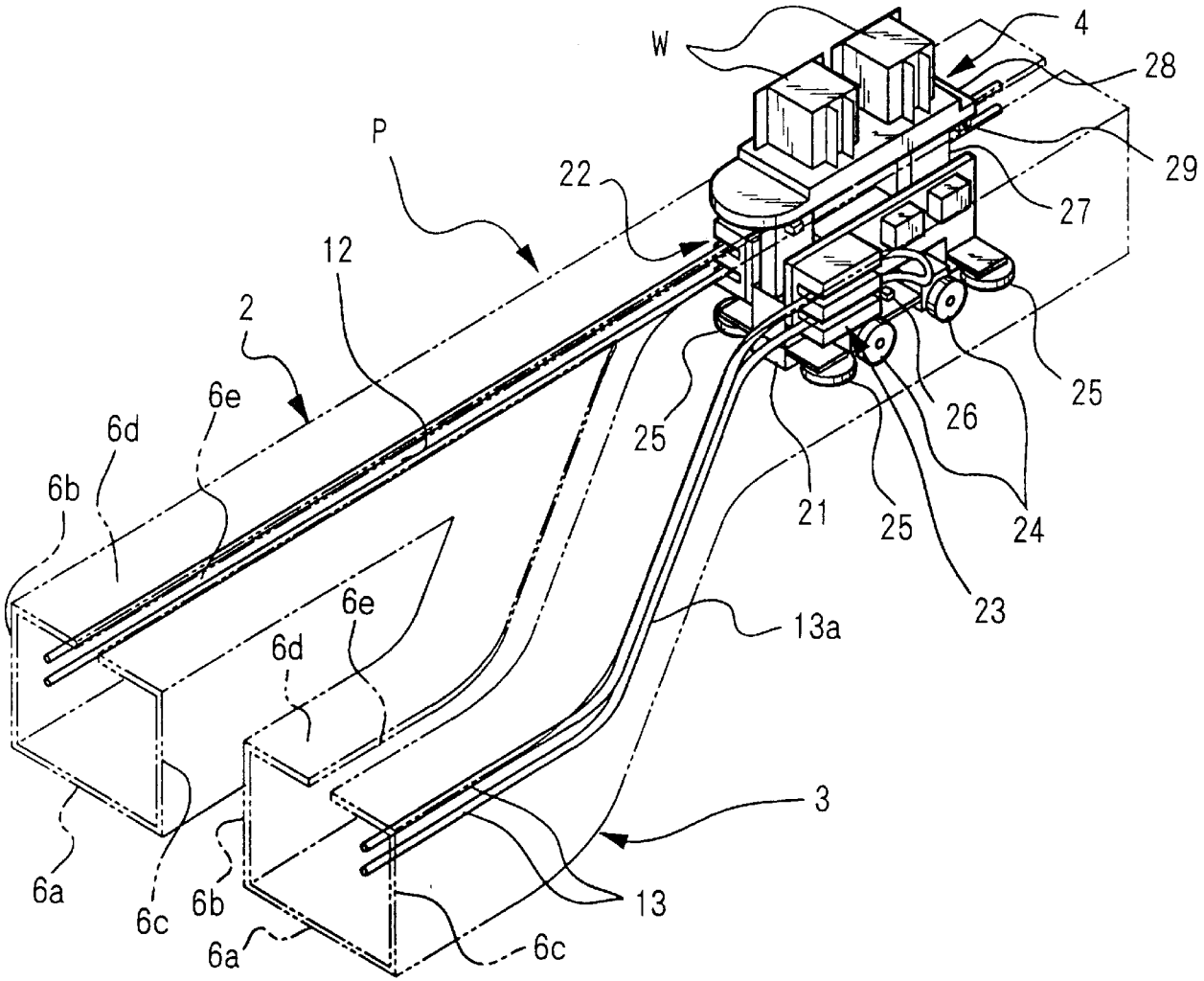
FIG. 2 is a perspective detailed view of the first embodiment.

FIG. 2 shows the relationship between the branch track 3 and the transport vehicle 4. The tracks 2 and 3 are formed of aluminum, and have rectangular shapes with a bottom wall 6*a*, right and left side walls 6*b* and 6*c*, and an upper wall 6*d*. A slit 6*e* extends along the center of the upper wall 6*d*.

A main route power supply line 12, for supplying electric power to the transport vehicle 4 in a non-contact manner, extends along the side wall 6*b* opposing the branch track 3. A branch route power supply line 13, for supplying electric power to the transport vehicle 4 in a non-contact manner, extends along the side wall 6*c* opposing the main track 2. The branch route power supply line 13 extends to the branch point P, and the portion of the branch route power supply line 13 overlapping with the main route power supply line 12 serves as a branch point power supply line 13*a*. The branch point power supply line 13*a* assists the supply of electric power given to the transport vehicle 4 moving from the main route power supply line 12 to the branch route power supply line 13. The power supply lines 12, 13, and 13*a* are connected to a high frequency power source.

Additionally, the main route power supply line and the branch route power supply line may be disposed along an identical side of the route whereas the branch point power supply line may be disposed along the opposing side at the branch point independently of the main and branch power supply lines.

The transport vehicle 4 is self-propelled, and has a body 21 with a rotational motor as a drive unit. The movable body 21 is accommodated in the tracks 2 and 3. The upright posts 27 from the upper side of the body 21 are inserted through the slit 6*e*, and a bed 28 for carrying the cassette W is attached to the top of the posts 27.

A pickup coil 22 for receiving electric power from the main route power supply line 12 in a non-contact manner is attached to the right side of the body 21 with respect to the direction of travel, while a pickup coil 23 for receiving electric power from the branch route power supply line 13 and the branch point power supply line 13*a* in a non-contact manner is attached to the left side of the body 21. Four drive wheels 24 are attached to the underside of the body 21 and rotate on the bottom wall 6*a* of the tracks 2 and 3. The drive wheels bear the vertical weight of the transport vehicle 4 and their direction can be turned by a steering mechanism 30 as a route selector. All or some of the drive wheels 24 are connected to the rotational drive motor to drive the transport vehicle 4. Side wheels 25 are attached to the right and left sides of the body 21 so as to rotate freely on the side walls 6*b* and 6*c* of the tracks 2 and 3 and to bear the horizontal weight of the transport vehicle 4. When other kinds of wheel-drive system are employed, this steering mechanism may also be employed.

The transport vehicle 4 has a drive control unit (not shown), control signal receiver 26, communication equipment 29 for communicating with the stations, and a sensor for avoiding a collision (not shown).

Figure 3:
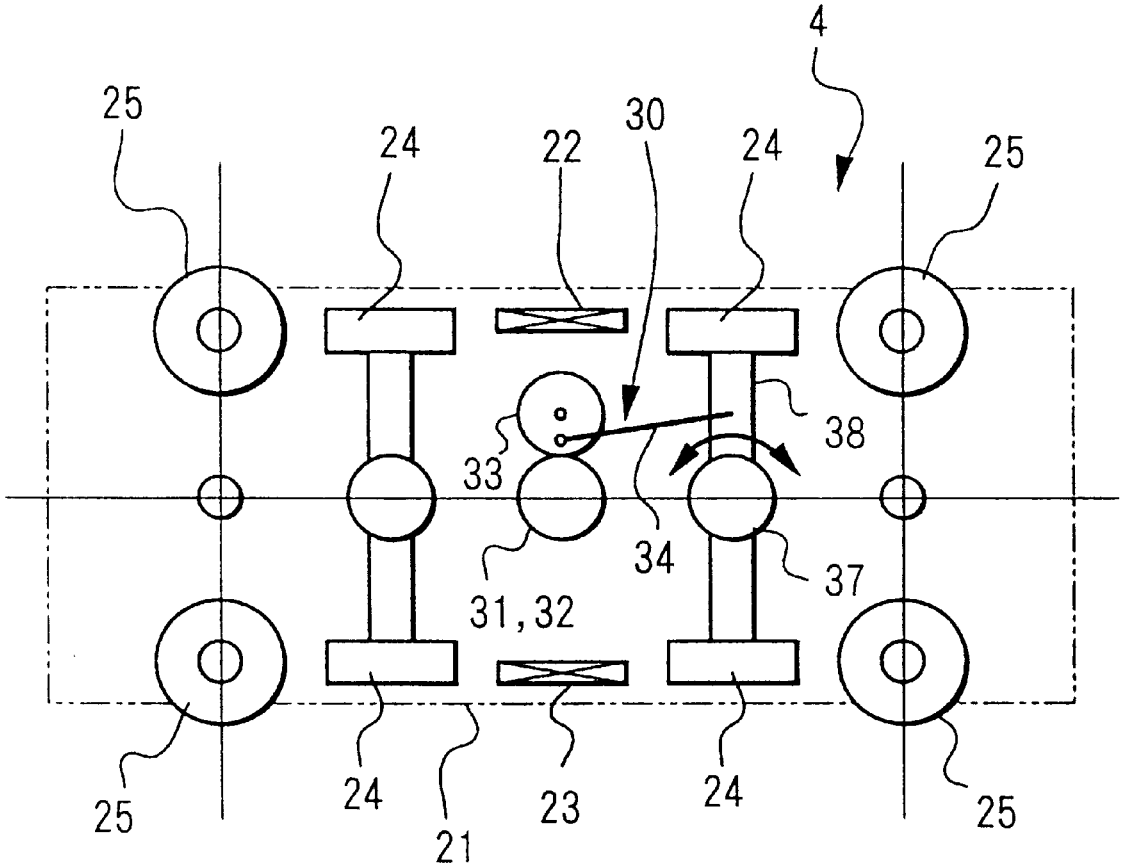
FIG. 3 is a bottom view of the transport vehicle of the first embodiment.

FIG. 3 shows the underside of the transport vehicle 4. The shaft 38 for the drive wheels 24 is rotatably supported on the pivot 37, and a steering mechanism 30 for turning the direction of the shaft 38 is provided. The steering mechanism 30 has a steering motor 31, a gear 32 fixed to the shaft 38, a rotation plate 33 with a gear engaging with the gear 32, and a link 34 for connecting the rotation plate 33 in order to turn the direction of the shaft 38 by rotation of the rotation plate 33.

When the transport vehicle 4 is being driven, the route of the transport vehicle 4 is decided before the branch point P. The drive wheels 24 are turned in the direction of the selected route so that the transport vehicle 4 is guided to the main or to branch tracks 2 or 3.

Figure 4:
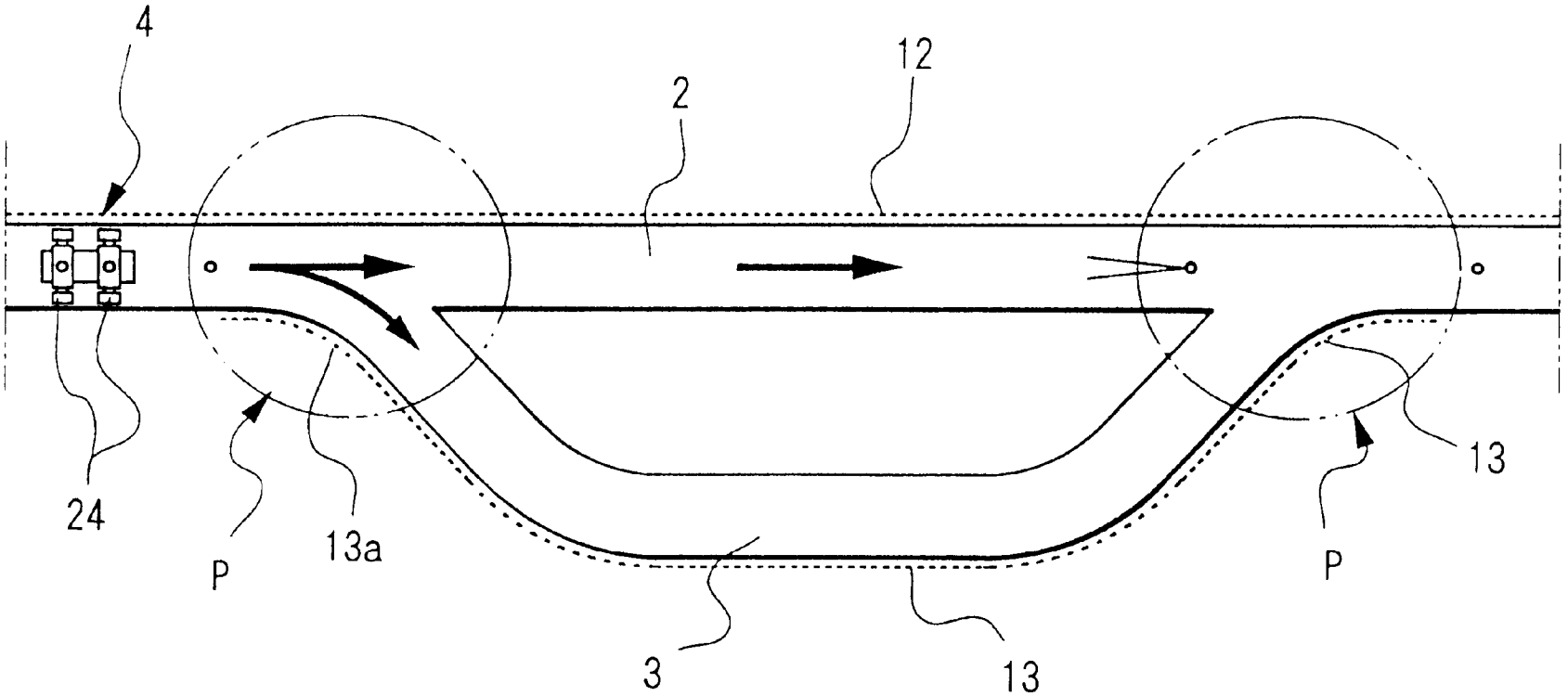
FIG. 4 is a top view showing the transport vehicle and the track of the first embodiment.

As shown in FIG. 4, when the transport vehicle 4 receives the electric power from the left main route power supply line 12 and arrives at the branch point P, the drive wheels 24 are turned to the right so that the transport vehicle 4 travels onto the branch track 3. When the pickup coil runs off the main route power supply line 12, the opposing pickup coil receives the electric power from the branch point power supply line 13*a* so that the transport vehicle 4 continues traveling. That is, the transport vehicle 4 receives electric power at least once from the branch point power supply line 13*a*, and thereafter receives electric power from the branch route power supply line 13 while traveling along the branch track 3.

As explained above, the switching track mechanism is not needed because the steering mechanism 30 for selecting the route is attached to the transport vehicle 4.

Additionally, the branch route power supply line 13 may be separated from the branch point power supply line 13*a* and may be disposed on the same side of the main route power supply line 12. In this construction, the pickup coil of the main route side is selected when the transport vehicle 4 goes into the branch track 3.

Second Embodiment

Figure 5A:
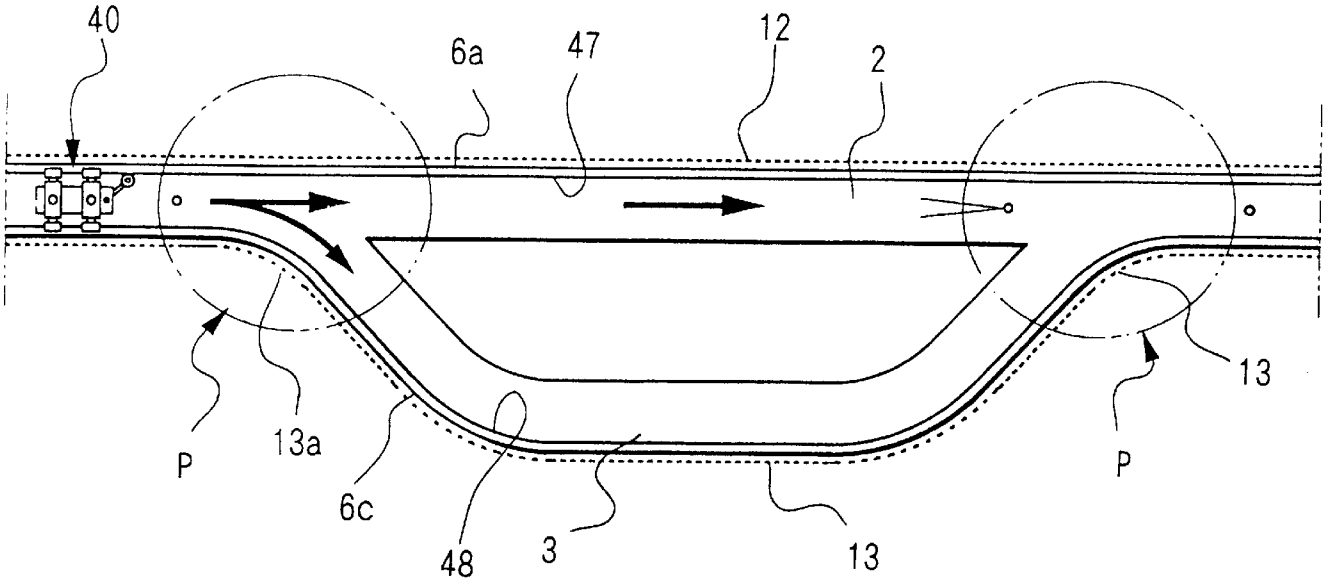
FIG. 5A is a top view showing a transport vehicle and a track of a second embodiment of the present invention.
Figure 5B:
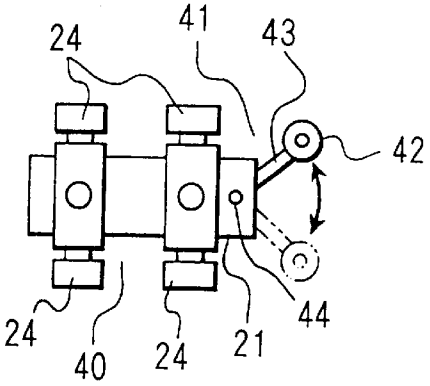
FIG. 5B is a top view of the transport vehicle of the second embodiment.
Figure 6:
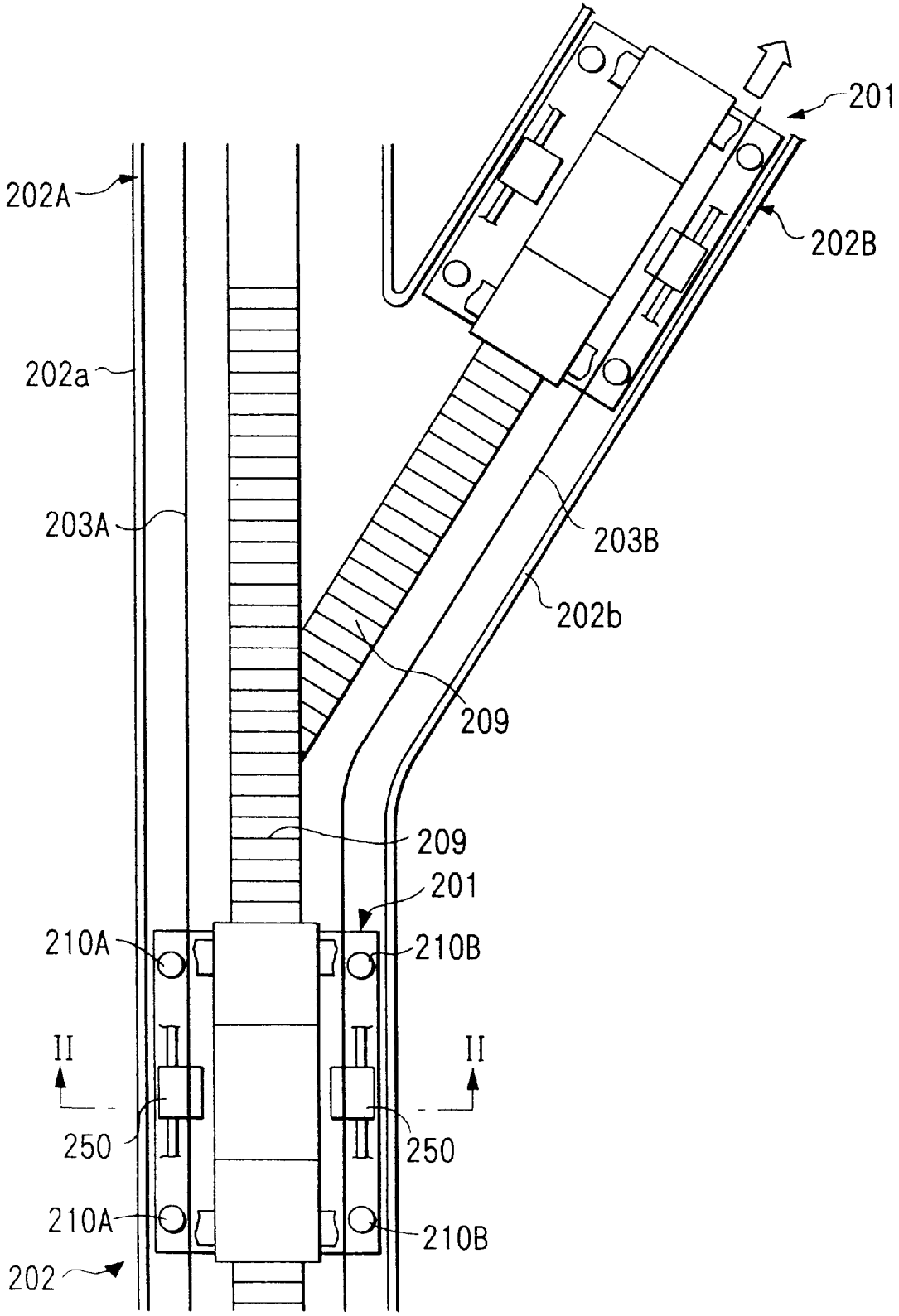
FIG. 6 is a top detailed view of a transport system of a third embodiment.

A second embodiment will be explained with reference to FIGS. 5A and 5B. The transport system has a magnetic guide rail 47 along the main track 2, and a magnetic guide rail 48 along the branch track 3. The guide rails 47 and 48 are made of strip steel, and extend along the side walls 6*b* and 6*c*, including the branch point P. A guide roller 41 is attached to the front of the transport vehicle 40. The guide roller 41 has a magnet guide roller 42 which can be attracted to the guide rails 47 and 48, an arm 43 capable of swinging from side to side which is connected to the shaft 44, and a guide drive means (not shown) for selectively directing the arm 43 to one of the guide rails 47 and 48.

With this construction, the magnet guide roller 42 is swung to the right before the branch point P, the transport vehicle 40 is guided along the right wall to go into the branch track 3. The magnet roller 42 and the magnetic guide rails 47 and 48 are not always necessary. Various other kinds of guides may be attached to the tracks 2 and 3, and other kinds of a movable contact portion, and other kinds of a guide selector for selectively contacting the contact portion to one of the guide may be employed.

When the transport vehicle 40 arrives at the junction point (which is also a branch point in the opposite direction), the route selecting operation is not always needed. When the travel direction is not limited, the junction point should be constructed in a fashion similar to the branch point.

A drive means is not limited to wheel-drive system in the above embodiments. A linear motor which includes a primary side on the vehicle and a secondary side of aluminum conductor on the track, may be employed to generate a driving force while wheels serve as a weight supporting means. A linear direct current motor which includes permanent magnets in which N- and S-poles are alternatively positioned on the track, may be employed to generate a driving force.

Third Embodiment

A third embodiment will be explained with reference to FIGS. 6 to 9. A transport system, shown in FIGS. 6 and 7, has a transport vehicle 201, a track 202 having a rectangular shape (box shape) for guiding the transport vehicle 201. The track 202 branches into a main track 202A and a branch track 202B at a branch point. The main body of the track 202 (other than the branch point) is made by extruding aluminum alloy, and the branch point is made by machine work or casting. Magnets 209 of a linear motor are attached on the center of the bottom face of the track 202, and S- and N-poles are alternatively arranged along the travel direction to generate a driving force for the transport vehicle 201.

A base 228 for supporting the track 202 is hung from a ceiling 229 of a clean room by means of bolts 226. A air cleaner (not shown) for supplying clean air and a ceiling filter 227 are provided above the ceiling 229. A cleaner 230 has a filter 230*a* and a ventilating fan 230*b*. A ventilation opening for collecting dust from the air is provided on the bottom of the track 202.

The transport track 202 and the transport vehicle 201 is covered with a cover 225 which comprises the side wall 202*a* and 202*b*, in order to prevent dust from being spread. A slit 233 is provided on the upper side of the cover 225, and power supply lines 207 for supplying electric power used for drive and control of the transport vehicle 201, are fixed to the inside of the side walls 202*a* and 202*b* by means of supports.

A main guide rail 203A and a branch guide rail 203*b* are provided in the track 202 so as to extend over at least the branch point. The main guide rail 203A extends on the inside wall from the transport track 202 to the main track 202A, and the branch guide rail 203B extends on the inside wall from the transport track 202 to the branch track 202A. The guide rails 203A and 203B has an L-shaped cross section, that is, each of the guide rails 203A and 203B comprises a vertical wall and a horizontal support for supporting the wall.

The transport vehicle 201 has wheels for rotating on the bottom of the track 202, side guide rollers 205 for contacting the inside wall of the track 202, and a pickup coil 6 (power receiver) for receiving electric power from the power supply line 207. The pickup coil 206 having an E-shaped cross section, is attached to the transport vehicle 201 in a non-contact manner with the power supply line 207, and supplies electric power to a control unit, etc., of the transport vehicle 201. The transport vehicle 201 has a coil 220 of a linear direct current motor for generating a driving force by magnetic induction process with a magnet 209 on the bottom of the track 202. The transport vehicle 201 has a support 222 projecting through the slit 233 out of the cover 225, and a controller 208 and a tray 223 are attached to the top of the support 222. The transport vehicle 201 travels along the rack 202 by means of the linear motor with articles loaded on the tray 223.

The transport vehicle 201 has left route selecting rollers (first rollers) 210A and right route selecting rollers (second rollers) 210B. Four route selecting rollers are in total attached to the front, rear, right, and left sides of the body. The route selecting rollers 210A and 10B select a route in which the transport vehicle 201 is to travel, serving as a route selector for guiding the transport vehicle 201. The rotation axes of the route selecting rollers 210A and 210B are vertically positioned, so that the route selecting rollers 210A and 210B are vertically alternatively movable along the axes. The left route selecting rollers 210A contacting the main guide rail 203A, guides the transport vehicle 201 to the main track 202A, whereas the right route selecting rollers 210B contacting the branch guide rail 203B, guides the transport vehicle 201 to the branch track 202B. When the transport vehicle 201 approaches the branch point, one of route selecting rollers 210A and 210B is moved up to engage with one of the guide rails 203A and 203B, thereby leading the transport vehicle 201 to the selected route.

Figure 8:
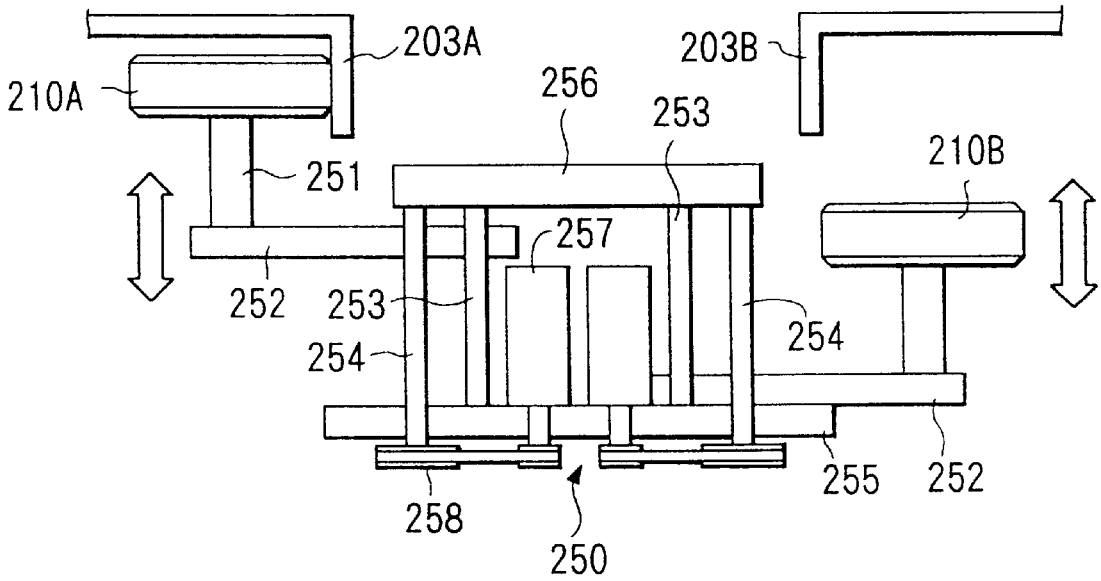
FIG. 8 is a front view of a drive mechanism 50 for route selecting rollers of the third embodiment.

FIG. 8 shows the construction of the mechanism 250 for moving the route selecting rollers 210A and 210B. The shafts 251 of the front, rear, left, and right route selecting rollers 210A and 210B are fixed to movable horizontal bases 252, in which vertical guide rods 253 are inserted so that the bases 252 can be moved up and down. Screws 254 are screwed in the base 252, so that the route selecting rollers 210A and 210B are moved up and down by rotating the screws 254 by means of a belt 258 and a motor 257. When the left route selecting rollers 210A are moved up to contact the vertical wall of the L-shaped left branch guide rail 203A, the transport vehicle 201 goes in the main track 202A along the left branch guide rail 203A. When the right route selecting rollers 210B are moved up to contact the vertical wall of the L-shaped right branch guide rail 203B, the transport vehicle 201 goes in the branch track 202B along the left branch guide rail 203B.

The controller 208 has a function for driving the left and right motors 257 of the drive mechanism 250. The controller 208 starts and stops supply of a current to the coil 220 of the linear direct current motor according to a start signal or a stop signal transmitted from a central control system (not shown), and drive the motor 257 to make one of the route selecting rollers 210A and 210B engage with one of the guide rails 203A and 203B according to a route selecting signal indicating change of route. A route map maybe stored in the controller 208 in advance, and the transport vehicle 201, receiving an instruction indicating a target station from the central control system, may determine a route.

Figure 7:
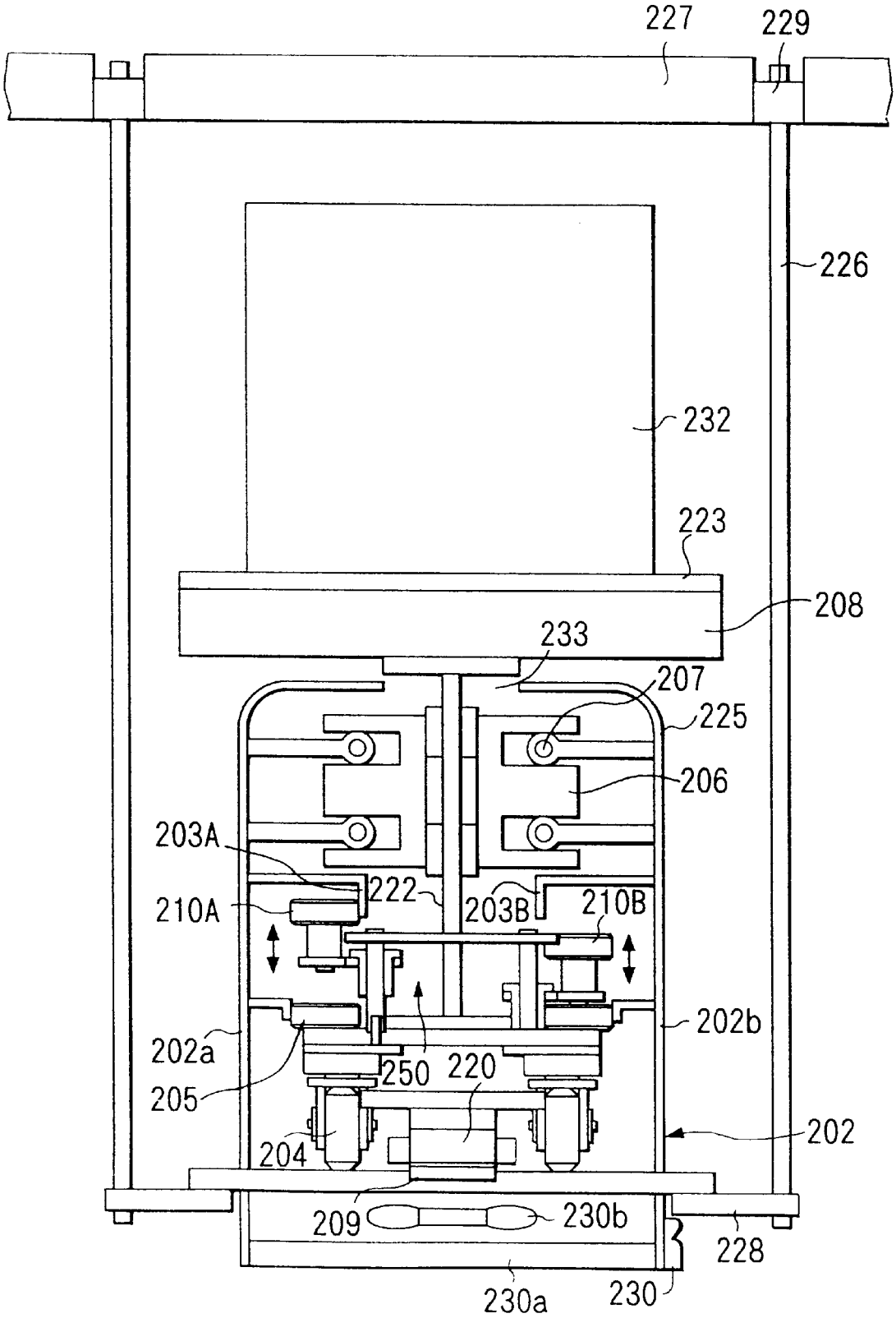
FIG. 7 is a cross-sectional view from line II—II of FIG. 6.

The operation of the third embodiment will be explained. As shown in FIG. 7, clean air flows from the ceiling filter 227 of the clean room through the slit 233 into the cover 225. In the rectangular track 202, the clean air reaches the bottom. The dust spread by the travel of the transport vehicle 201 is drawn with air by the fan 230*a* of the air cleaner 230, and is collected by the filter 230*b* while only clean air is supplied to the clean room.

Figure 9:
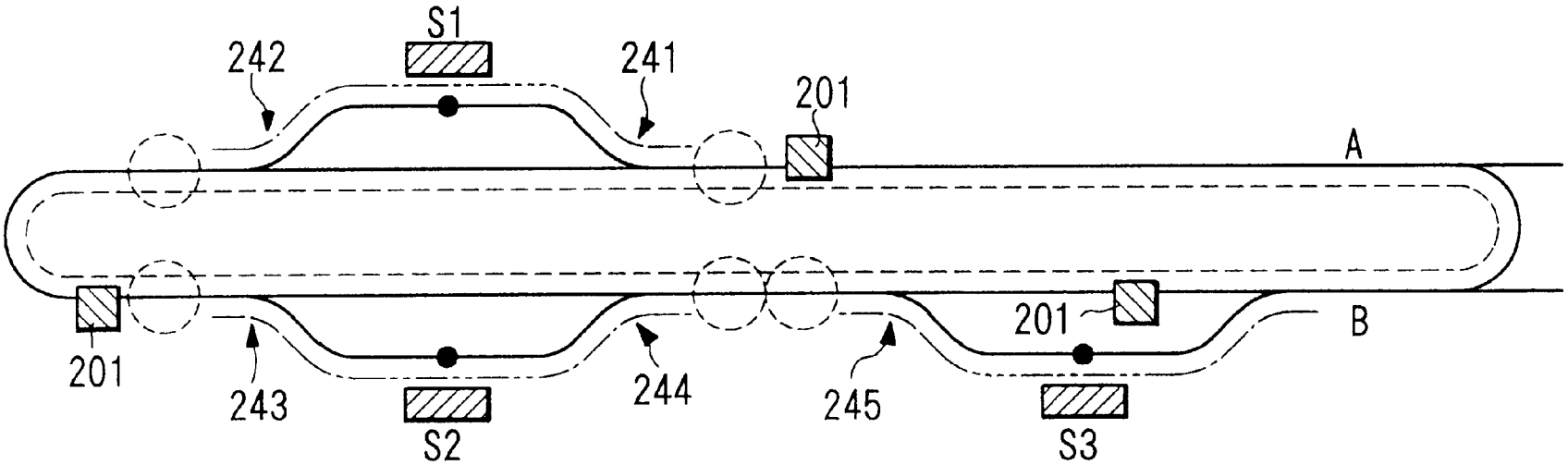
FIG. 9 is a top view of the transport system of the third embodiment.
Figure 10:
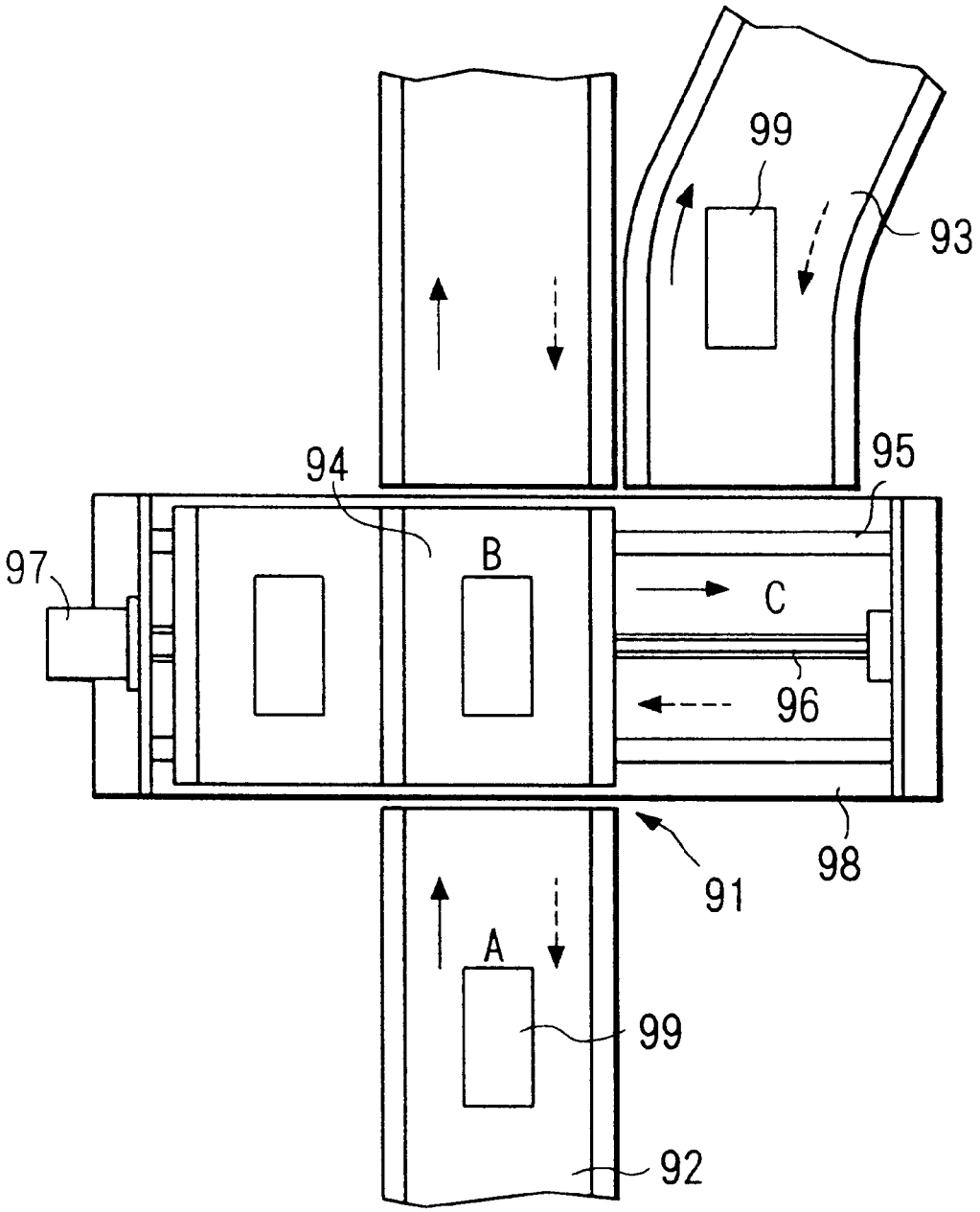
FIG.10 PRIOR ART
FIG. 10 is a top view of a sliding-type track change mechanism of the prior art.
Figure 11:
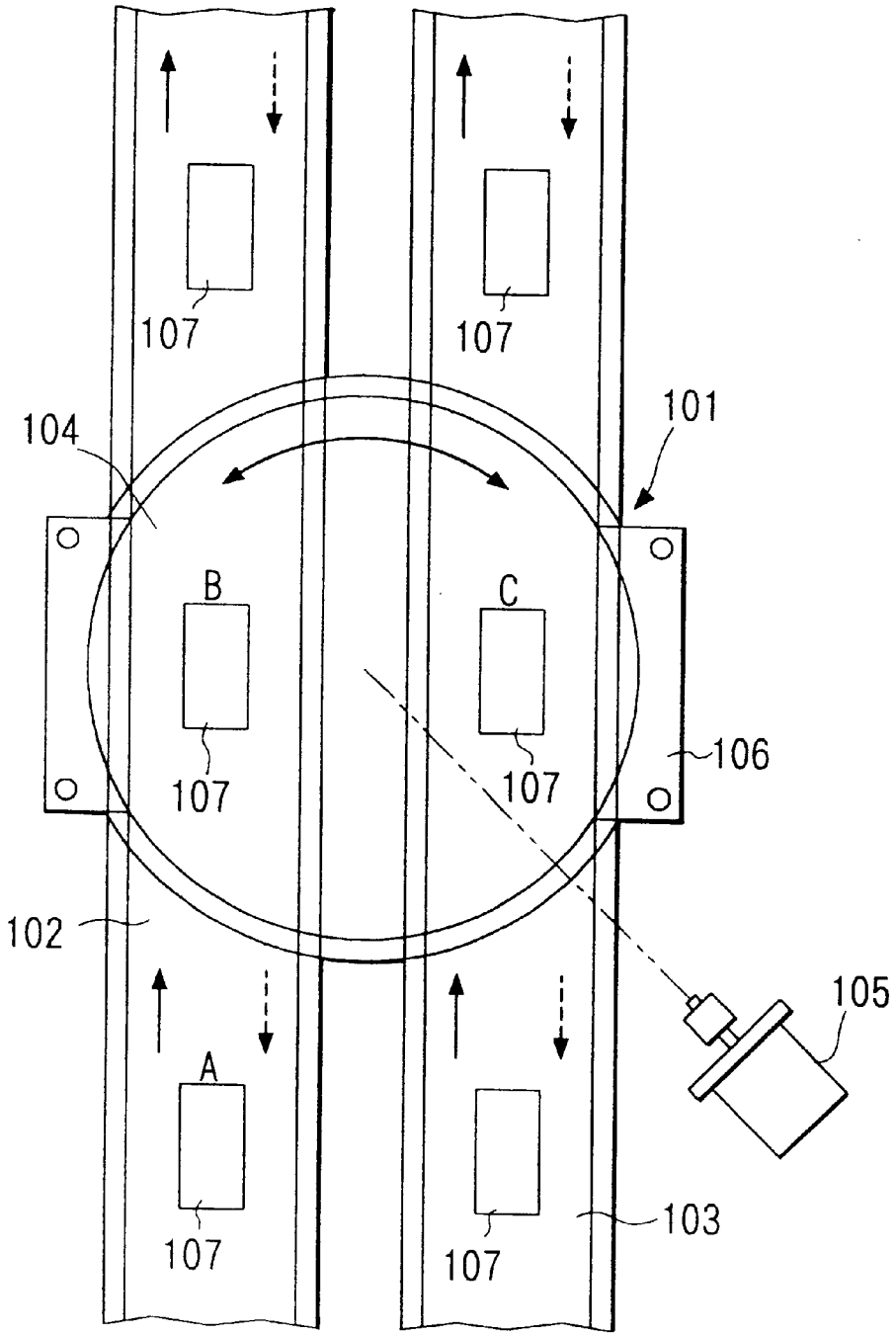
FIG.11 PRIOR ART
FIG. 11 is a top view of a turntable-type track change mechanism of the prior art.
Figure 12A:
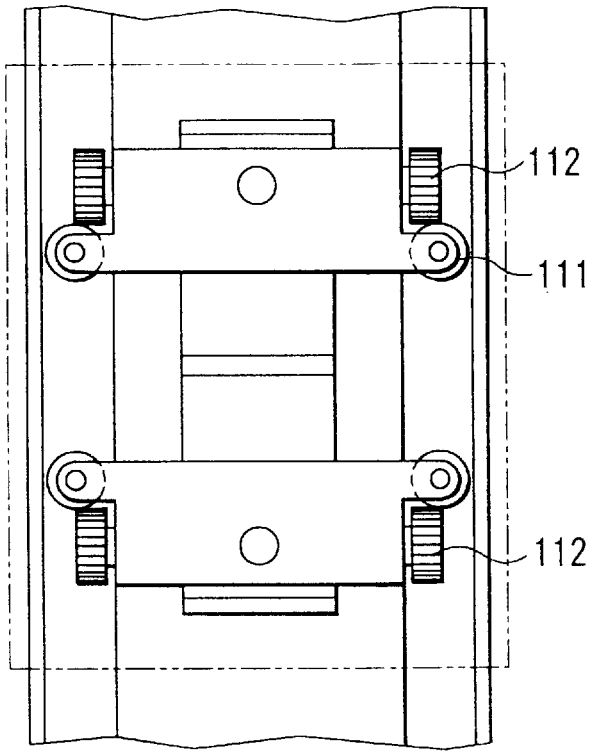
FIG.12A PRIOR ART
FIG. 12A is a top view of a transport vehicle of the prior art.
Figure 12B:
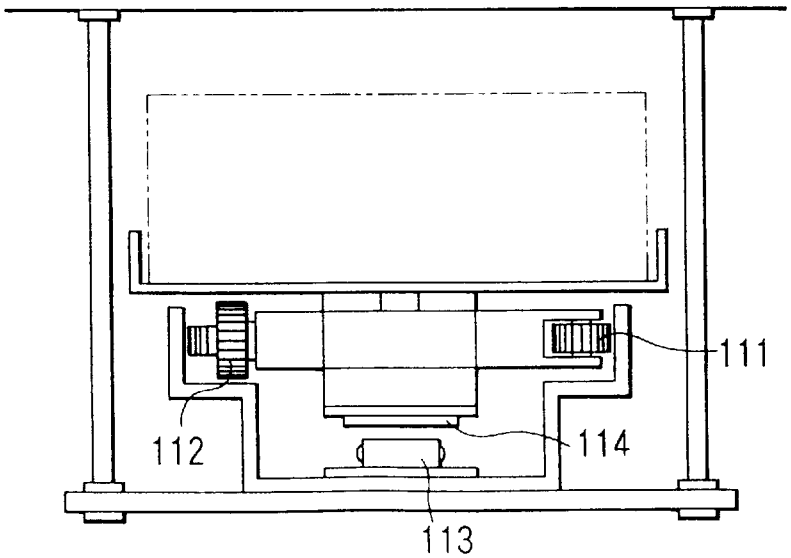
FIG.12B PRIOR ART
FIG. 12B is a front view of the transport vehicle of the prior art.

Referring to FIG. 9, the travel of the transport vehicle 201, for example, in case the transport vehicle 201 starts traveling from a starting point A, loads transfer objects at a station S1, unloads the transfer objects at a station S3, and reaches a destination point B, will be explained. The transport vehicle 201, receiving an instruction signal from the central control system (not shown), starts to travel from the starting point A by supplying a current to the coil 220 of the linear direct current motor through the controller 208.

Before the branch point 241, the transport vehicle 201 recognizes the branch point 241 by node marks or by illumination of a light emitter, at which point the transport vehicle 201 receives a route selecting signal for the branch point 41. According to the route selecting signal, the controller 208 controls the motor 257 of the drive mechanism 250. The right route selecting rollers 210B are moved up and the left route selecting rollers 210A are moved down, so that the transport vehicle 201 goes into the right branch track.

The transport vehicle 201 stops at the station S1 according to the signal from the central control system, and the transfer objects are loaded on the tray by a loading and unloading device. The transport vehicle 201 starts again and travels through the junction point 242 into the main track.

Before the branch point 243, the transport vehicle 201 recognizes the branch point 243 by node marks or by illumination of a light emitter, at which point the transport vehicle 201 receives a route selecting signal for the branch point 243. According to the route selecting signal, the controller 208 controls the motor 257 of the drive mechanism 250. The left route selecting rollers 210B are moved up and the right route selecting rollers 210A are moved down, so that the transport vehicle 201 goes into the left branch track. At the next branch point 245, the transport vehicle 201 travels through the right track in the similar operation, and unloads the transfer objects at the station S3.

In the above transport system, the switching track mechanism such as the sliding-type track change mechanism and the turntable-type track change mechanism is not needed because the route is selected by the movable route selecting rollers 210A and 210B, thereby lowering material and running costs. The guide rails 203A and 203B which engage with the route selecting rollers 210A and 210B are disposed inside the rectangular track 202, so that a measure for preventing influence by the dust can be easily applied because the contacting and rotating portions are not exposed. In addition, the drive unit of the transport vehicle 201 is not limited to the linear motor. The ceiling filter 227 and the air cleaner 230 are not always necessary.

This invention may be embodied in other forms or carried out in other ways without departing from the spirit thereof. The present embodiments are therefore to be considered in all respects illustrative and not limiting, the scope of the invention being indicated by the appended claims, and all modifications falling within the meaning and range of equivalency are intended to be embraced therein.

What is claimed is:

1. A transport system comprising:

a track provided along a transport route comprising a main route and at least one branch route connected to said main route at a branch point;

a first power supply line provided along said main route;

a second power supply line provided along said branch route;

a transport vehicle for moving along said track;

a linear direct current motor, attached to said transport vehicle, for producing a driving force for the vehicle, said linear direct current motor comprising a coil of a primary unit which faces said track and is attached to the underside of said vehicle, and a permanent magnet with S- and N-poles alternatively arranged on the track, said linear direct current motor generating an electromagnetic force from an electric armature current through said coil and from a magnetic flux of said permanent magnets;

a pickup coil, attached to said transport vehicle, for receiving electric power in a non-contact manner from said first and second power supply lines so as to supply electric power to said drive unit;

a main guide rail for supporting and guiding said transport vehicle, said main guide rail extending along said main route;

a branch guide rail for supporting and guiding said transport vehicle, said branch guide rail extending along said branch route;

a first roller attached to said transport vehicle, said first roller being movable to contact said main guide rail to guide said transport vehicle to said main route;

a second roller attached to said transport vehicle, said second roller being movable to contact said branch guide rail to guide said transport vehicle to said branch route; and a guide selector for selectively contacting one of said first roller and said second roller selectively to one of said main guide rail and said branch guide rail, wherein said first and second rollers are fixed to respective movable horizontal bases, respectively, in which guide rods are inserted to guide the movements of said bases, and ball screws are screwed in said bases, so that said first and second rollers are independently moved by rotating the ball screws.

2. A transport system according to claim 1, wherein said guide selector moves said first roller and said second roller vertically.

3. A transport system according to claim 1, wherein said main and branch guide rails each comprises a vertical wall for supporting said rollers, and a horizontal support for supporting said walls.

4. A transport system according to claim 1, wherein said guide selector moves said first roller and said second roller vertically, each of said main and branch guide rails comprising a vertical wall for supporting said rollers, and a horizontal support for supporting said walls.

5. A transport system according to claim 1, further comprising a cover for covering said transport route and said transport vehicle.

6. A transport system according to claim 5, further comprising an air cleaner for collecting dust from said transport route.

7. A transport system according to claim 6, further comprising an air supply means for supplying clean air into said cover, said air cleaner collecting the dust and exhausting clean air out of said cover.

8. A transport system according to claim 5, wherein said track and said cover form a rectangular cross section.

* * * * *